US005655660A

United States Patent [19]

Dolin et al.

[11] Patent Number: 5,655,660

[45] Date of Patent: Aug. 12, 1997

[54] CONTAINER FOR USE IN ROBOTIC DRUG RETRIEVAL SYSTEM

[76] Inventors: Lisa M. Dolin; Mark D. Allen, both c/o Cardinal Health, Inc. 655 Metro Pl. South, Dublin, Ohio 43017

[21] Appl. No.: 551,904

[22] Filed: Oct. 23, 1995

[51] Int. Cl.[6] ..... B65D 77/04

[52] U.S. Cl. ..... 206/538; 206/493; 220/475; 229/125.125

[58] Field of Search ..... 206/493, 499, 206/526, 528, 538, 739, 804, 806; 220/475; 229/125.12, 125.125

[56] References Cited

U.S. PATENT DOCUMENTS

| | | | |
|---|---|---|---|
| 2,967,611 | 1/1961 | Bolinger | 206/806 |
| 3,148,770 | 9/1964 | Cosman | 206/806 |
| 3,519,123 | 7/1970 | Nagle et al. | 229/125.125 |
| 3,952,872 | 4/1976 | Consiglio, Jr. | 206/526 |
| 4,072,232 | 2/1978 | Marsman et al. | 206/806 |
| 4,111,297 | 9/1978 | Paulin | 206/526 |
| 4,202,451 | 5/1980 | Berkowitz | 206/526 |
| 4,537,311 | 8/1985 | Wilkinson | 206/528 |
| 5,232,095 | 8/1993 | Childers et al. | 206/493 |

*Primary Examiner*—Jimmy G. Foster

*Attorney, Agent, or Firm*—Kremblas, Foster, Millard & Pollick

[57] ABSTRACT

A pharmaceutical distribution container is provided having a sleeve and a tray. The tray has four walls, also known as sidewall portions, each preferably of a trapezoidal configuration. At least a portion of the thickness of each of the opposed first and third sidewall portions is greater than the thickness of each of the opposed second and fourth sidewall portions. The sleeve has a top surface, a bottom surface and two end surfaces, each preferably of a rectangular configuration. A pharmaceutical retaining means is provided, with this component secured between opposing portions of the sidewall of the tray in respective recessed portions. Additionally, the pharmaceutical retaining means is formed having a rod with two end caps, one of which is preferably fixed while the other is preferably removable.

19 Claims, 5 Drawing Sheets

CONTAINER FOR USE IN ROBOTIC DRUG RETRIEVAL SYSTEM

FIELD OF THE INVENTION

This invention concerns a pharmaceutical distribution container and more specifically one which is utilized in a drug retrieval system, which system is robotic.

BACKGROUND OF THE INVENTION

An important aspect of health care concerns the cost effective distribution of pharmaceuticals. This is especially important in settings such as hospitals, where the pharmaceuticals for a large number of patients are commonly dispensed from a central pharmacy housed within the hospital. Hospitals typically employ a number of pharmacists and pharmacy technicians to oversee the hospital's pharmacy. Additionally, a relatively large inventory is kept on hand due to the rapid depletion of stock. Obviously, employing several individuals to do a job which is associated with sporadic activity is subject to review in the face of what some view as spiralling health care costs. Additionally, freeing pharmacists to spend more of their time with doctors and patients improves the quality of the health care provided.

Concerns about the increasing cost of health care have lead to the introduction of automated drug retrieval systems, some of which systems utilize robotics. There are several advantages associated with the use of robotics. First, there are the obvious savings in salaries, since individuals are replaced with machines. Second, there is a greater reliability associated with robotics that incorporate bar code scanning which select an item for retrieval as opposed to the possibility of human error in reading the item to be retrieved. This significantly redues the potential for pharmacy malpractice. Third, there is the elimination of product being misappropriated from a storage area by individuals for their own subsequent use or resale.

In one example of an existing robotic drug retrieval system, or a robotic medication dispensing system as it is also known, the pharmaceutical to be retrieved is typically placed inside a sealed plastic bag for subsequent scanning and selection. The robotic drug retrieval system has as part of a hospital's central pharmacy a secured area having two opposing walls with pegs thereon and with a robot which circulates within this area. As a pharmacy technician loads a pharmacy cart for the distribution of pharmaceuticals to various patients, the technician in a robotic drug retrieval system utilizes a patient tray having affixed thereto bar codes identifying the name of particular patients and their locations within the hospital. The robotic drug retrieval system thereafter selects the specific drugs required to be delivered to a particular patient and puts them into the patient tray and provides the filled tray to the pharmacy technician for subsequent distribution to the patient. Once the sealed plastic bags have been removed from their corresponding pegs on the walls by the robot, it becomes necessary to restock that distribution area. In order for this to be done, the robot must place new bags on the pegs.

Additional concerns regarding costs have resulted in the decision to design a reusable container for use with one of the leading robotic drug retrieval systems. A reusable container not only assists in controlling health care costs, but facilitates better and easier control of inventory.

It is thus apparent that the need exists for an improved pharmaceutical distribution container or the like for use with robotic drug retrieval systems.

SUMMARY OF THE INVENTION

The problems associated with developing a container for use with a robotic drug retrieval system, which container is reusable, are overcome in accordance with the present invention by forming of a pharmaceutical distribution container with a tray and a sleeve. The tray has a base as well as a sidewall, and in addition includes means for retaining pharmaceuticals within the tray. Meanwhile, the sleeve is formed having a top surface, a bottom surface, and two end faces, with the sleeve encasing the tray.

The sidewall of the container actually has a first sidewall portion, a second sidewall portion, a third sidewall portion, and a fourth sidewall portion. In the preferred embodiment of the invention, the means for retaining pharmaceuticals within the tray involves the use of a rod. This rod is secured between the first sidewall portion and a third sidewall portion. The means for retaining pharmaceuticals also utilize at least one packet containing a pharmaceutical.

In the preferred embodiment of the invention, each of the first, second, third and fourth sidewall portions is of a trapezoidal shape. Additionally, the first and third sidewall portions have the same dimensions in the preferred embodiment of the invention as do the second and fourth sidewall portions. Additionally, in the preferred embodiment of the invention, each of the first and third sidewall portions are thicker than each of the second and fourth sidewall portions.

Each packet has an aperture formed therein, through which aperture the aforementioned rod passes. The first sidewall portion and third sidewall portion each have a recessed portion formed therein, while the rod has a first and a second end, such that the first end of the rod rests in the first sidewall portion recessed portion and the second rod end rests in the third sidewall portion recessed portion.

Each of the first, second, third, and fourth sidewall portions has a top edge as well as a bottom edge. The distance between the first sidewall portion top edge and the third sidewall portion top edge is greater than the distance between the first sidewall bottom edge and the third sidewall portion bottom edge. Similarly, the distance between the second sidewall portion top edge and the fourth sidewall portion top edge is greater than the distance between the second sidewall portion bottom edge and the fourth sidewall portion bottom edge.

The sleeve of the container has both of its end faces having the same dimensions. Additionally, the top surface, the bottom surface and the end faces of the sleeve are of a rectangular configuration, with the top surface and bottom surface being parallel to one another. Finally, the end faces of the sleeve have a top edge and a bottom edge with the distance between the top edge of each of the end faces being greater than the distance between the bottom edge of each of the end faces.

There is also disclosed a pharmaceutical distribution container having a tray and sleeve, with the tray having a base, a sidewall, and means for retaining pharmaceuticals within the tray, with the means for retaining the pharmaceuticals within the tray including a rod. The sleeve has a top surface, a bottom surface and two end faces with the top and bottom surfaces being parallel to one another. The sleeve of this invention is formed so as to encase the tray.

The sidewall actually includes a first sidewall portion, a second sidewall portion, a third sidewall portion and a fourth sidewall portion. Additionally, the means for retaining pharmaceuticals within the tray includes at least one packet containing a pharmaceutical, with the packet having an aperture formed therein, through which aperture the rod passes. With respect to the rod, it is secured between the first sidewall portion and the third sidewall portion, with the first sidewall portion and third sidewall portion each having a recessed portion formed therein. The rod has a first and second end, with the first end resting in the first sidewall portion recessed portion and the second end resting in the third sidewall portion recessed portion. The first and third sidewall portions have the same dimensions as do the second and fourth sidewall portions. Additionally, each of the first, second, third and fourth sidewall portions have a top edge and a bottom edge with the distance between the first sidewall portion top edge and the third sidewall portion top edge being greater than the distance between the first sidewall portion bottom edge and the third sidewall portion bottom edge. Similarly, the distance between the second sidewall portion top edge and the fourth sidewall portion top edge are greater than the distance between the second sidewall portion bottom edge and the fourth sidewall portion bottom edge.

There is also disclosed a pharmaceutical distribution container having a base, a sidewall, and means for retaining pharmaceuticals within the container. The sidewall has a first sidewall portion, a second sidewall portion, a third sidewall portion, and a fourth sidewall portion. The means for retaining pharmaceuticals within the tray includes a rod, with the rod secured between the first sidewall portion and the third sidewall portion.

Additionally, the first sidewall portion and the third sidewall portion each have a recessed portion formed therein. The rod has a first and a second end, and the first end rests in the first sidewall portion recessed portion while the second end rests in the third sidewall portion recessed portion. At least a portion of the thickness of each of the first and third sidewall portions is greater than the thickness of each of the second and fourth sidewall portions.

In the preferred embodiment of the invention, each of the first, second, third, and fourth sidewall portions is of a trapezoidal shape and each of the first and third sidewall portions is thicker than each of the second and fourth sidewall portions. Also, the end faces of the sleeve each have a top edge and a bottom edge with the distance between the top edge of each of the end faces being greater than the distance between the bottom edge of each of the end faces.

It is the primary object of the present invention to provide a pharmaceutical distribution container which is reusable, easy to fabricate, inexpensive and effective at its job.

Another objective of the invention is to reduce the labor cost associated with the loading process and the maintenance of the system.

Still another objective of the invention is to minimize the cost of packaging in the system, since it is reusable.

Yet still another objective of the invention is to minimize the hospital's waste management costs.

Other objects and advantages of the invention will be apparent from the following description, the accompanying drawings and the appended claims.

DETAILED DESCRIPTION OF THE INVENTION

Figure 1:
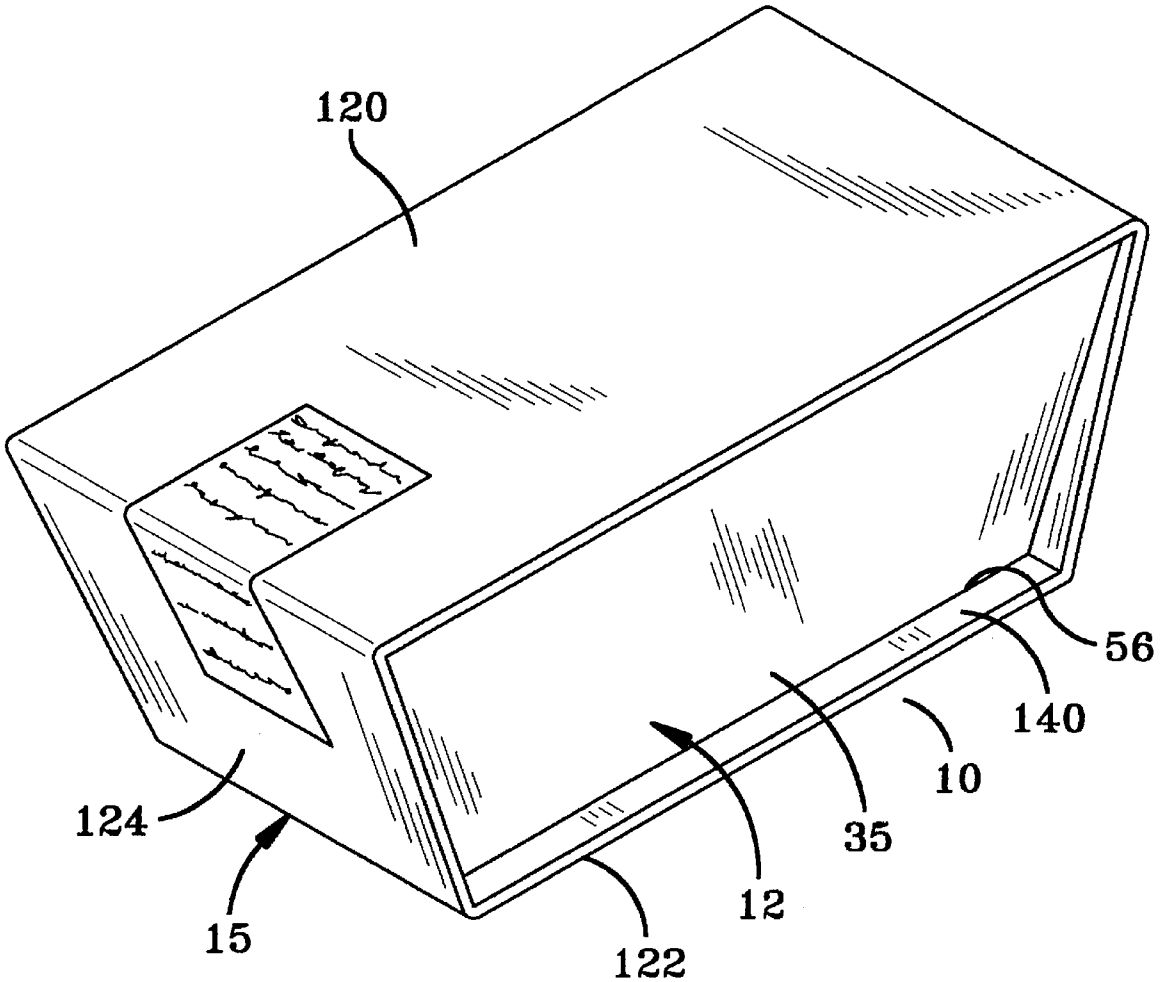
FIG. 1 is a perspective view of a container for use in a robotic drug retrieval system made in accordance with the present invention.

Having reference to the drawings, attention is first directed to FIG. 1 which discloses a container for use in robotic drug retrieval systems, which container is designated generally by the numeral 10. In comparing FIGS. 1 and 2, it will be observed that container 10 has as its primary components a tray 12 and a sleeve 15. Both of these components in the preferred embodiment of the invention are formed of cardboard of the type found in cardboard boxes, although other materials such as plastic or other paper products could be used.

As can be appreciated from a comparison of FIGS. 1–5 and 7, the tray 12 associated with container 10 is formed with a base 20 and sidewall 23, as well as a pharmaceutical retaining means 25. It will be readily appreciated that base 20 has both an interior surface 26 and an exterior surface 28, both of which in the preferred embodiment of the invention are parallel to one another and planar. Similarly, the sidewall 23 is formed having four planar walls, each of which has both interior and exterior surfaces. First sidewall portion 30 is formed having an interior surface 31 and an exterior surface 32. Second sidewall portion 35 is formed having an interior surface 36 and an exterior surface 37. Third sidewall portion 40 is formed having an interior surface 41 and an exterior surface 42. Finally fourth sidewall portion 45 is formed having an interior surface 46 and an exterior surface 47.

Each of the four sidewall portions, in addition to being planar, are preferably of a trapezoidal configuration. For example, first, second, third and fourth sidewall portions 30, 35, 40 and 45 each have a respective top edge 50, 51, 52 and 53 as well as respective bottom edges 55, 56, 57, and 58. Each top edge is preferably longer in length than the corresponding bottom edge. Additionally, each of the top edges is preferably parallel to the corresponding bottom edge.

In the preferred embodiment of the invention, instead of each of the sidewalls being perpendicular to base 20, each is inclined approximately 7½° from the vertical such that the distance between the top edges 50, 52, of the first and third sidewall portions 30, 40 are spaced a greater distance from one another than the bottom edges 55, 57 of the respective first and third sidewall portions 30,40. Similarly, the top edges 51, 53 of the second and fourth sidewall portions 35, 45 respectively are spaced a greater distance from each other than are the bottom edges 56, 58 of the corresponding second and fourth sidewall portions 35, 45.

Comparing FIGS. 2, 4, 5 and 7 it will be noted that with respect to first sidewall portion 30 and third sidewall portion 40 that each is formed from a much larger wall section which is then folded over to effectively result in a double-wall configuration. This double-wall configuration better protects the contents of the tray. Thus, first sidewall portion 30 is formed having a first sidewall first portion 60 and a first sidewall second portion 61 interconnected by top edge 50. Similarly, the third sidewall portion is formed having a third sidewall first portion 65 and a third sidewall second portion 66. This also results in at least a portion of each of the first and third sidewall portions being thicker than each of the second and fourth sidewall portions. Put another way, at least a portion of the thickness of each of said first and third sidewall portions is greater than the thickness of each of said second and fourth sidewall portions.

Figure 2:
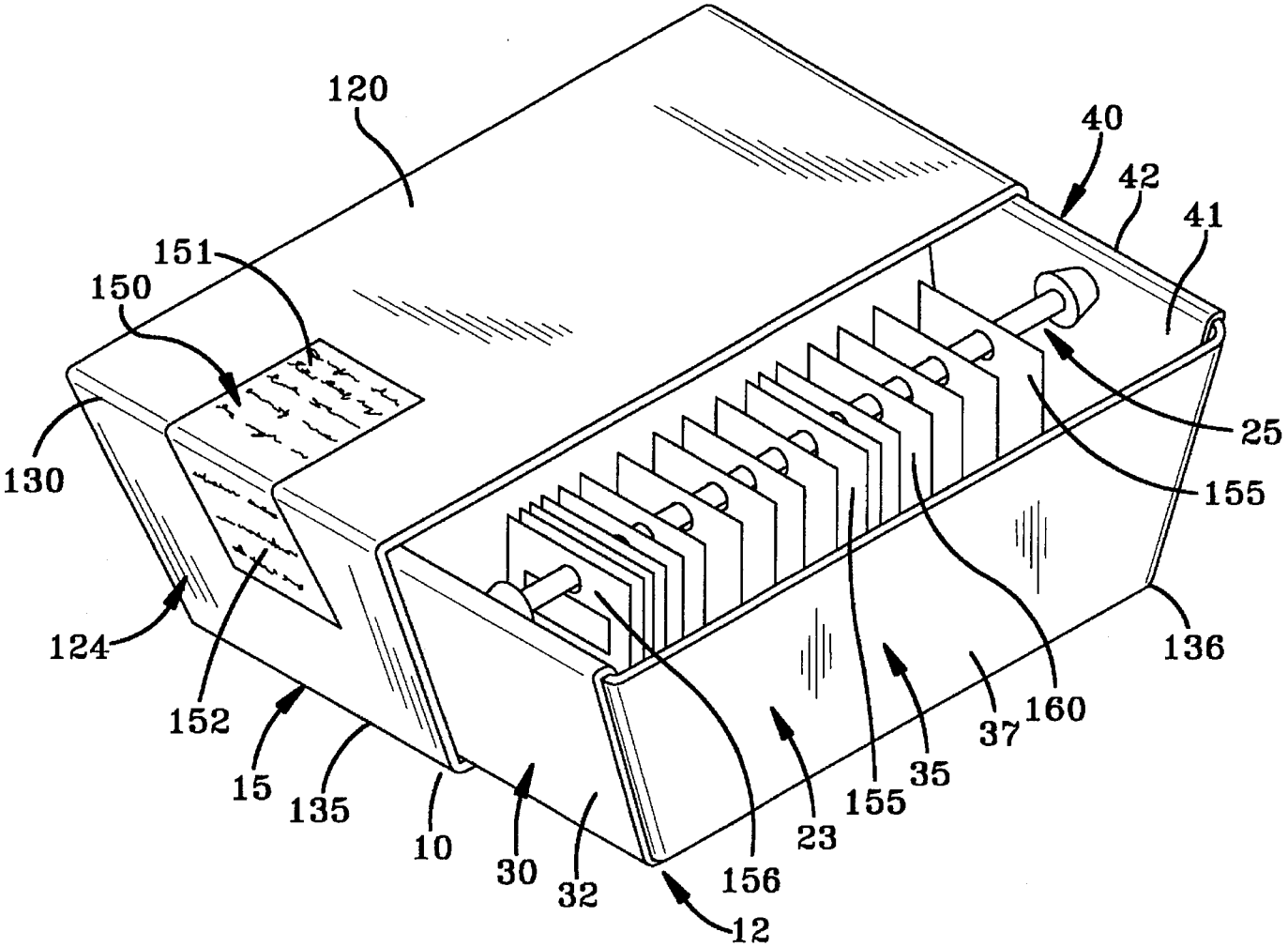
FIG. 2 is a perspective view showing the container partially opened.
Figure 3:
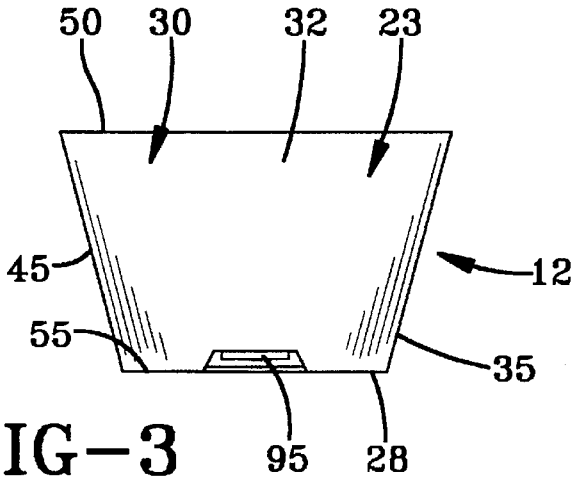
FIG. 3 is front elevational view of the tray component of the invention.
Figure 4:
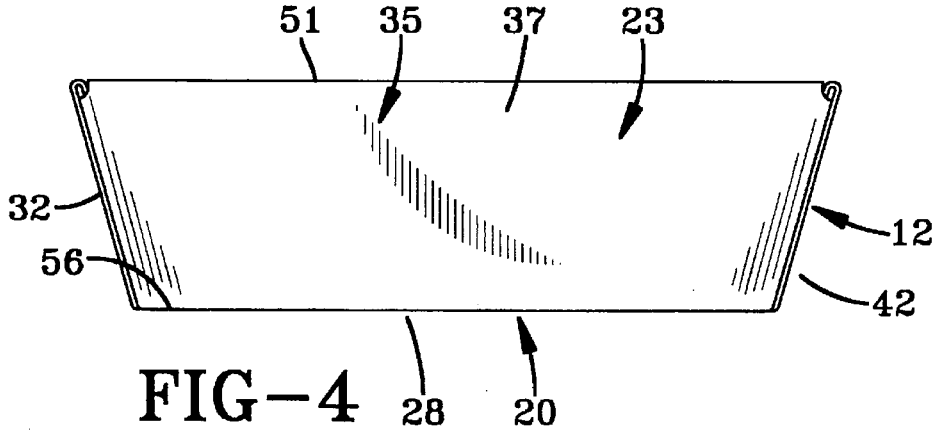
FIG. 4 is a side elevational view of the tray component of this invention.
Figure 5:
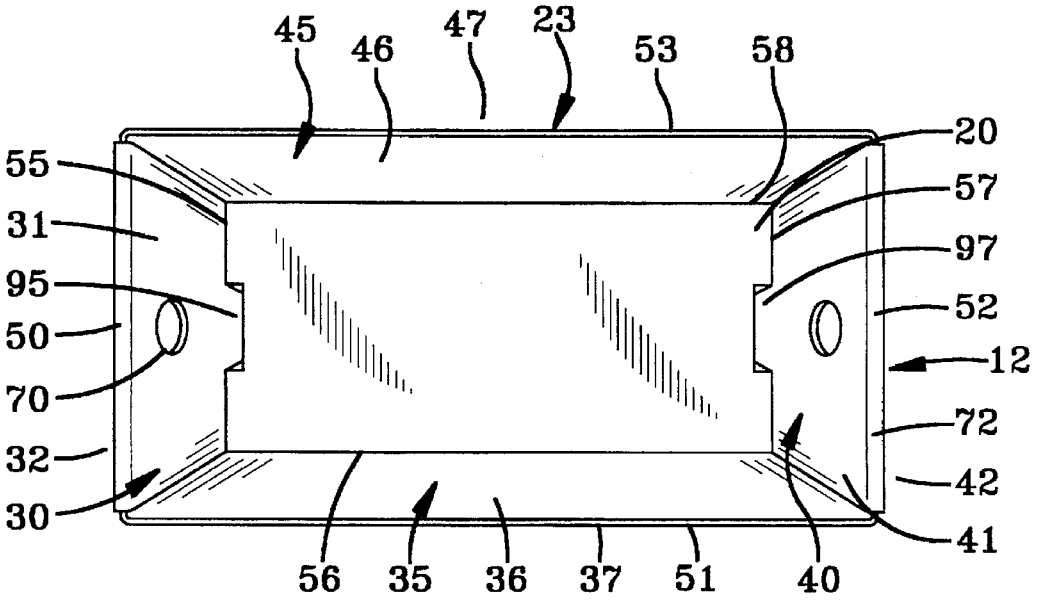
FIG. 5 is a top plan view of the tray component of this invention.
Figure 7:
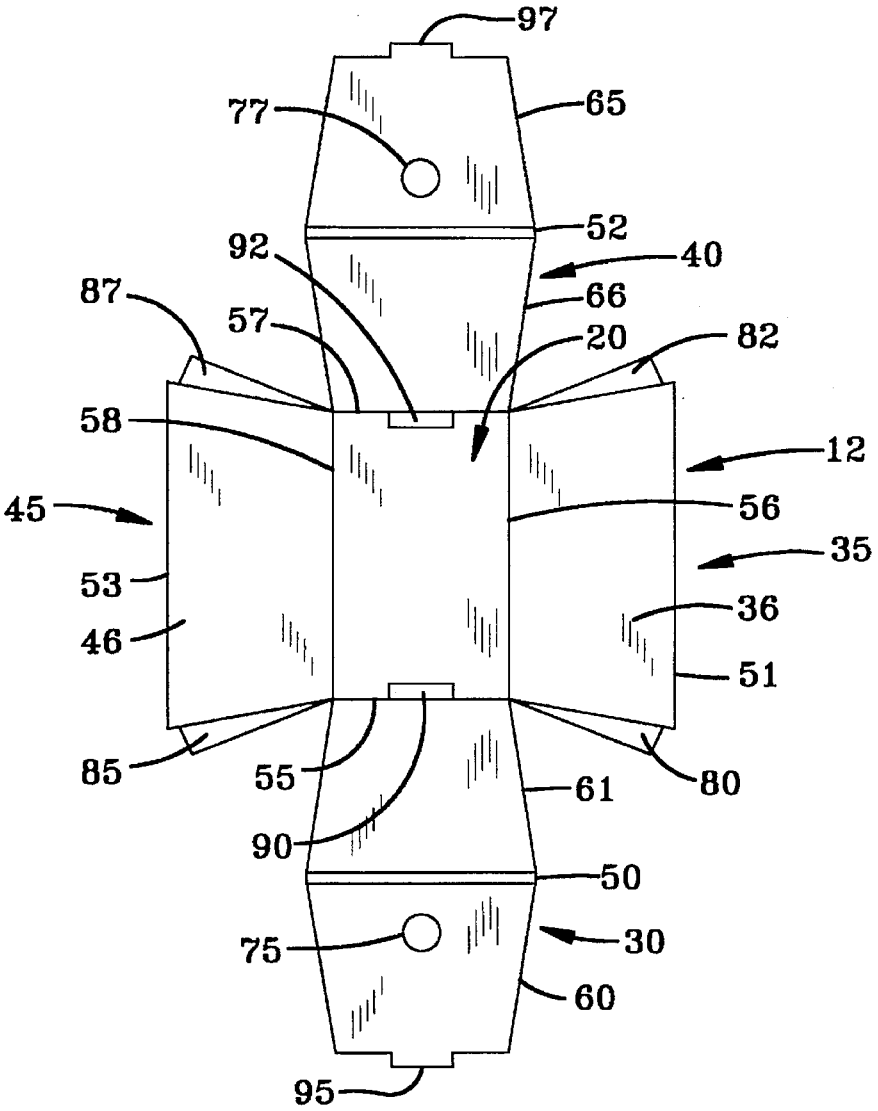
FIG. 7 is a top plan view of the container in its pre-assembled state.
Figure 8:
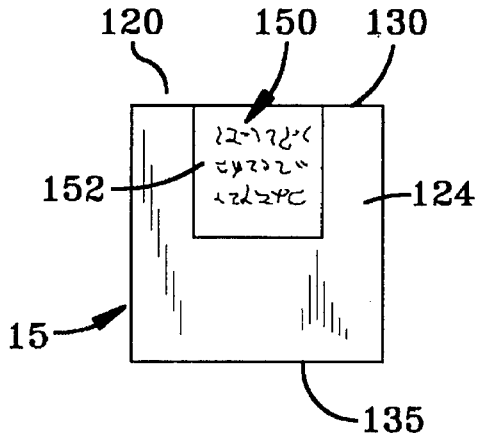
FIG. 8 is a front elevational view of the sleeve of the invention.
Figure 9:
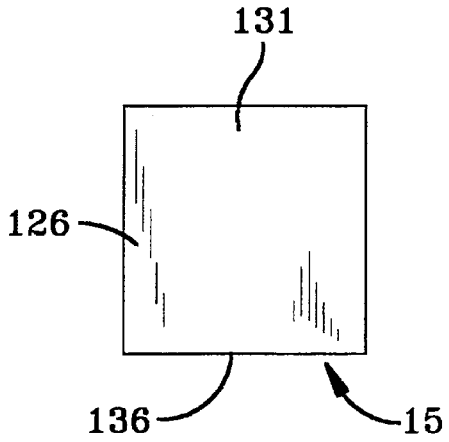
FIG. 9 is a rear elevational view of the sleeve associated with the invention.
Figure 10:
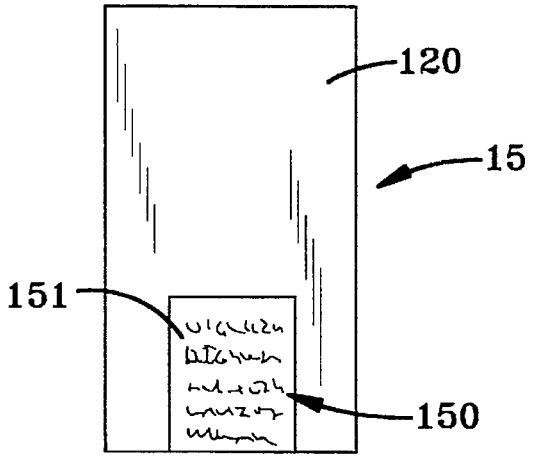
FIG. 10 is a top plan view of the sleeve associated with the invention.
Figure 11:
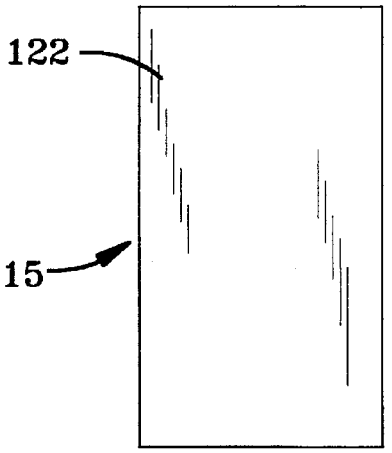
FIG. 11 is a bottom plan view of the sleeve associated with the invention.
Figure 12:
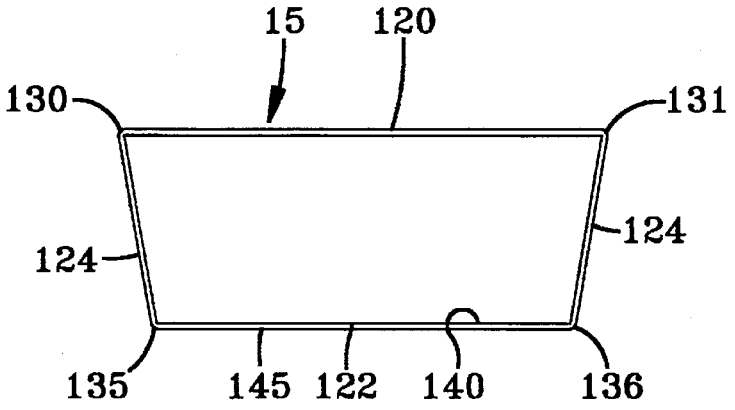
FIG. 12 is a side elevational view of the sleeve associated with the invention.

Comparing FIGS. 2, 5 and 7 it will be also be appreciated that within first sidewall portion 30 and third sidewall portion 40 are formed recessed portions 70, 72 respectively. Recessed portion 70 is formed as the result of the presence of a first sidewall portion aperture 75 in first sidewall first portion 60. Meanwhile, recessed portion 72 is formed as a result of the existence of a third sidewall portion aperture 77 in third sidewall first portion 65.

A comparison of FIGS. 7 and 5 discloses that second sidewall portion 35 features a second sidewall portion flange 80 as well as a second sidewall portion flange 82. Each of the two flanges are at opposite ends of the sidewall portion. Similarly, fourth sidewall portion 45 has fourth sidewall portion flange 85 as well as fourth sidewall portion flange 87. Each of these flanges are also at opposite ends of the fourth sidewall portion. As can best be appreciated from reference to FIG. 7, each of the flanges 80, 82, 85, and 87 are folded inwardly relative to final assembled tray 12 such that when the first and third sidewall portions 30, 40 respectively are folded inwardly, the flanges are retained, as can best be appreciated from FIG. 5, between first sidewall first portion 60 and first sidewall second portion 61, as well as between third sidewall first portion 65 and third sidewall second portion 66. Specifically, flanges 82 and 87 are retained within the third sidewall portion 40, while flanges 80 and 85 are retained within the first sidewall portion 30.

Assisting in the assembly of tray 12 are a base first aperture 90 and a base second aperture 92. These generally oblong slots occur adjacent bottom edges 55, 57 respectively as part of base 20. Each aperture 90, 92 is dimensioned such that first sidewall portion tab 95 and third sidewall portion tab 97 are able to be inserted through the corresponding aperture. Thus, when the tray is assembled as shown in FIG. 2 or 5, a sturdy paperboard tray exists.

The primary component of the pharmaceutical retaining means 25 is rod 100, preferably formed of a metal such as aluminum or stainless steel. Rod 100 has a first end 102 and a second end 104 as can best be appreciated from FIG. 6. First end 102 has a first end cap 106 fitted thereon. Similarly, second end 104 has a second end cap 108 fitted thereon. In the preferred embodiment of the invention, the exterior surface 110 of rod 100 is held in frictional engagement with the respective end caps 106 and 108. This engagement is accomplished through the insertion of the first end 102 of rod 100 through the first end cap aperture 112 and by the insertion of the second end 104 of rod 100 through the second end cap aperture 114.

Figure 6:
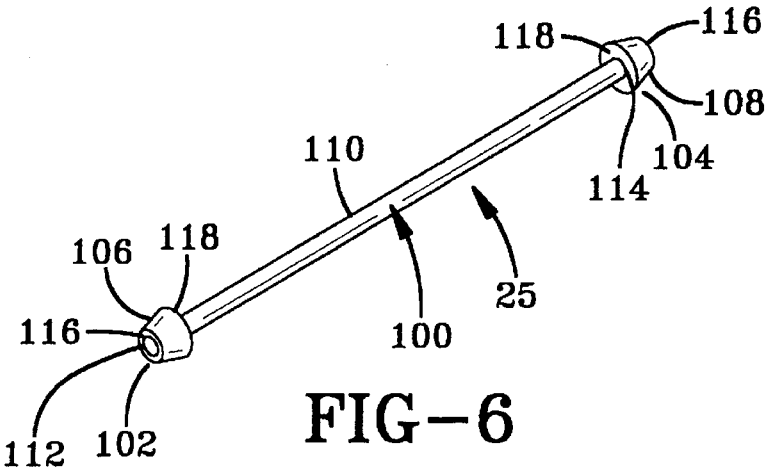
FIG. 6 is a perspective view of a portion of the means for retaining pharmaceuticals component of the invention.

It will be appreciated from FIG. 6 that each of the end caps 106, 108 are of a fructo-conical configuration. First end cap 106 is for positioning within recessed portion 70 on the first sidewall portion 30. That particular end cap is fixedly secured to rod 100. Meanwhiles the second end cap 108 is designed to be located within the recessed portion 72 of third sidewall portion 40. This can be better appreciated from viewing FIG. 2. Additionally, the second end cap 108 is removable from rod 100.

When assembled, the means for retaining pharmaceuticals 25 has the two end caps 106, 108 oriented on rod 100 so that the outermost end surfaces 116 are of a smaller diameter than the innermost end surfaces 118. This facilitates the insertion of the end caps into the recessed portions 70, 72.

Turning now to the structure associated with sleeve 15, it can be readily appreciated from a comparison of FIGS. 1, 8, 9, 10, 11 and 12 that the sleeve 15 is formed having a top surface 120, a bottom surface 122, and end faces 124 and 126. Preferably each of those surfaces 120, 122, 124 and 126 are rectangular in shape as well as being planar. The two end faces 124 and 126, in addition to preferably having the same dimensions, each have a sleeve end face top edge 130, 131 respectively. Furthermore, each end face 124, 126 has a sleeve end face bottom edge 135, 136 respectively. It will be appreciated that the distance between the end face top edges 130, 131 is greater than the distance between the sleeve end face bottom edges 135, 136. As a result, from the side, the sleeve also exhibits a trapezoidal appearance in the preferred embodiment, as can best be appreciated by FIG. 12.

The sleeve has an interior surface 140 and an exterior surface 145. The dimensioning of the sleeve and tray is such that there is a frictional fit between the two which assist in retaining the tray within the sleeve. For example, in one embodiment of the invention the sleeve is 4⅛" tall, 6½" wide, and 18¾" long. Meanwhile, the tray is 4" tall, 6¼" wide, and 18¾" long.

It will also be appreciated from a comparison of FIGS. 1, 2, 8, and 10 that sleeve 15 has affixed thereto a label 150. Label 150 has a label first portion 151 which is located on the top surface 120 of the sleeve and a label second portion 152 located on the one end face 124. Preferably the label first portion includes information such as the lot number and the expiration date of the pharmaceuticals within the container as well as any storage instructions, cautions, or warnings. Meanwhile, the label second portion 152 includes information relative to the type of pharmaceutical in the container.

Also part of the pharmaceutical retaining means 25 are a plurality of packets 155 each of which has a label 156 either thereon or affixed thereto. Preferably each of these packets are fabricated from transparent plastic and have an aperture 158 through which rod 100 passes. These packet apertures 158 are preferably located near the top of each packet so that the remainder of the packet hangs down into the interior of the tray. For assistance in the distribution of the pharmaceuticals contained within each of the containers associated with the invention, a divider 160, preferably a colored paperboard card, maay be placed on the rod 100 so as to designate packets in groups of a predetermined number, preferably ten.

In actual use, the tray shown in FIG. 7 is assembled into the tray shown in FIG. 5. Thereafter the pharmaceutical retaining means is secured within the tray with the packets of pharmaceuticals retained thereon as shown in FIG. 2. The tray is then inserted within the sleeve, such that the sleeve encases the tray. The tray is retained in the sleeve by a frictional fit, which fit permits the relatively easy removal of the tray from the sleeve when desired, but otherwise functions to prevent accidental disengagement. This results in a pharmaceutical distribution container which can then be advantageously utilized in a drug retrieval system, which system is robotic. When the tray is empty, the empty trays are nestable. Additionally, the tray as well as the rod, including its end caps are reusable. The relatively small number of pharmaceuticals associated with each container permit greater economic control to be exercised over inventory.

While the form of apparatus herein described constitutes a preferred embodiment of the invention, it is to be understood that the invention is not limited to this precise form of apparatus, and that changes maybe made therein without departing from the scope of the invention which is defined in the appended claims.

What is claimed is:

1. A pharmaceutical distribution container comprising, a tray, said tray comprising a base, sidewall, and means for retaining pharmaceuticals within said tray, said sidewall comprising a first sidewall portion, a second sidewall portion, a third sidewall portion, and a fourth sidewall portion, each said first, second, third, and fourth sidewall portions being of a trapezoidal shape, each of the first, second, third, and fourth sidewall portions having a top edge and a bottom edge with the distance between said first sidewall portion top edge and said third sidewall portion top edge being greater than the distance between said first sidewall portion bottom edge and said third sidewall portion bottom edge, said means for retaining pharmaceuticals within said tray comprising a rod, said rod secured between said first sidewall portion and said third sidewall portion, and a sleeve, said sleeve comprising a top surface, a bottom surface, and two end faces, said sleeve encasing said tray.

2. The container according to claim 1 wherein said means for retaining pharmaceuticals within said tray comprises at least one packet containing a pharmaceutical.

3. The container according to claim 1 wherein said first sidewall portion and said third sidewall portion each have a recessed portion formed therein, said rod having a first and a second end, said first end resting in said first sidewall portion recessed portion and said second end resting in said third sidewall portion recessed portion.

4. The container according to claim 1 wherein said first and third sidewall portions have the same dimensions, and said second and fourth sidewall portions have the same dimensions.

5. The container according to claim 1 wherein each of said first and third sidewall portions is thicker than each of said second and fourth sidewall portions.

6. The container according to claim 1 wherein said packet has an aperture formed therein through which aperture said rod passes.

7. The container according to claim 1 wherein each of the first, second, third, and fourth sidewall portions have a top edge and a bottom edge with the distance between said second sidewall portion top edge and said fourth sidewall portion top edge being greater than the distance between said second sidewall portion bottom edge and said fourth sidewall portion bottom edge.

8. The container according to claim 1 wherein said end faces of said sleeve have the same dimensions.

9. The container according to claim 1 wherein said top surface and said bottom surface of said sleeve are of a rectangular configuration and are parallel to one another.

10. The container according to claim 1 wherein said end faces of said sleeve each have a top edge and a bottom edge with the distance between the top edge of each of said end faces being greater than the distance between the bottom edge of each of said end faces.

11. A pharmaceutical distribution container comprising, a tray, said tray comprising a base, sidewall, and means for retaining pharmaceuticals within said tray, said means for retaining pharmaceuticals within said tray comprising a rod, said sidewall comprising a first sidewall portion, a second sidewall portion, a third sidewall portion, and a fourth sidewall portion, said means for retaining pharmaceuticals within said tray comprising at least one packet containing a pharmaceutical, said packet having an aperture formed therein through which aperture said rod passes, said rod secured between said first sidewall portion and said third sidewall portion, said first sidewall portion and said third sidewall portion each having a recessed portion formed therein, said rod having a first and a second end, said first end resting in said first sidewall portion recessed portion and said second end resting in said third sidewall portion recessed portion, said first and third sidewall portions having the same dimensions, and said second and fourth sidewall portions having the same dimensions, each of the first, second, third, and fourth sidewall portions having a top edge and a bottom edge with the distance between said first sidewall portion top edge and said third sidewall portion top edge being greater than the distance between said first sidewall portion bottom edge and said third sidewall portion bottom edge, and the distance between said second sidewall portion top edge and said fourth sidewall portion top edge being greater than the distance between said second sidewall portion bottom edge and said fourth sidewall portion bottom edge, and a sleeve, said sleeve comprising a top surface, a bottom surface, and two end faces, said top surface and said bottom surface of said sleeve being parallel to one another, said sleeve encasing said tray.

12. The container according to claim 11 wherein each of said first, second, third, and fourth sidewall portions is of a trapezoidal shape, and each of said first and third sidewall portions is thicker than each of said second and fourth sidewall portions.

13. The container according to claim 11 wherein said end faces of said sleeve each have a top edge and a bottom edge with the distance between the top edge, of each of said end faces being greater than the distance between the bottom edge of each of said end faces.

14. The container according to claim 11 wherein said end faces of said sleeve have the same dimensions.

15. The container according to claim 11 wherein said top surface and said bottom surface of said sleeve are of a rectangular configuration and are parallel to one another.

16. A pharmaceutical distribution container comprising a base, a sidewall, and means for retaining pharmaceuticals within said container, said sidewall comprising a first sidewall portion, a second sidewall portion, a third sidewall portion, and a fourth sidewall portion, said means for retaining pharmaceuticals within said container comprising a rod, said rod secured between said first sidewall portion and said third sidewall portion, said first sidewall portion and said third sidewall portion each having a recessed portion formed therein only extending partially therethrough, said rod having a first and a second end, said first end resting in said first sidewall portion recessed portion and said second end resting in said third sidewall portion recessed portion.

17. The container according to claim 16 wherein at least a portion of the thickness of each of said first and third sidewall portions is greater than the thickness of each of said second and fourth sidewall portions.

18. A pharmaceutical distribution container comprising, a tray, said tray comprising a base, sidewall, and means for retaining pharmaceuticals within said tray, said sidewall comprising a first planar sidewall portion, a second planar sidewall portion, a third planar sidewall portion, and a fourth planar sidewall portion, said first planar sidewall portion and said third planar sidewall portion each having a recessed portion formed therein only extending partially therethrough, said means for retaining pharmaceuticals within said tray comprising a rod, said rod being secured between said first planar sidewall portion and said third planar sidewall portion, and a sleeve, said sleeve comprising a top surface, a bottom surface, and two end faces, said sleeve encasing said tray.

19. The container according to claim 18 wherein said rod has a first and a second end, said first end resting in said first planar sidewall portion recessed portion and said second end resting in said third planar sidewall recessed portion.

* * * * *